US005944111A

United States Patent [19]

Bridges

[11] Patent Number: 5,944,111

[45] Date of Patent: Aug. 31, 1999

[54] INTERNAL RISER TENSIONING SYSTEM

[75] Inventor: Charles D. Bridges, Cypress, Tex.

[73] Assignee: ABB Vetco Gray Inc., Houston, Tex.

[21] Appl. No.: 08/975,741

[22] Filed: Nov. 21, 1997

[51] Int. Cl.[6] ..... E21B 33/043

[52] U.S. Cl. ..... 166/348; 166/75.14; 166/382

[58] Field of Search ..... 166/348, 368, 166/75.14, 382

[56] References Cited

U.S. PATENT DOCUMENTS

| | | | |
|---|---|---|---|
| 4,258,792 | 3/1981 | Restarick | 166/378 |
| 4,278,278 | 7/1981 | Chambless et al. | 285/143 |
| 5,080,174 | 1/1992 | Hynes | 166/382 |
| 5,551,803 | 9/1996 | Pallini, Jr. et al. | 405/223.1 |
| 5,607,019 | 3/1997 | Kent | 166/344 |
| 5,638,903 | 6/1997 | Kent | 166/348 |
| 5,653,289 | 8/1997 | Hosie et al. | 166/348 |
| 5,671,812 | 9/1997 | Bridges | 166/348 |
| 5,839,512 | 11/1998 | Malone et al. | 166/348 |

*Primary Examiner*—Hoang C. Dang
*Attorney, Agent, or Firm*—James E. Bradley

[57] ABSTRACT

An offshore well system has an assembly for tensioning an inner riser or casing string. The system has a hanger which lands on an internal load shoulder. The hanger has a gripping mechanism on its lower end which engages a mandrel, the mandrel being connected to tieback casing. The gripping mechanism allows upward moving of the mandrel relative to the hanger, but not downward movement. A running tool releasably engages an interior portion of the mandrel. A launch adapter secures to an upper end of the hanger. The launch adapter slidingly engages a running string which also extends upward through a blowout preventor. Closing the blowout preventor and applying pressure to the launch adapter causes it to move downward, pushing the hanger onto the load shoulder. Subsequently, the running tool is pulled upward to apply tension to the casing which is held by the griping mechanism. The running tool is retrieved along with the launch adapter. The load shoulder may be retractable to remove tension for retrieving the casing.

25 Claims, 10 Drawing Sheets

INTERNAL RISER TENSIONING SYSTEM

TECHNICAL FIELD

This invention relates in general to a system for tensioning a string of casing or riser extending between a subsea wellhead and a surface wellhead located on an offshore platform, and in particular to a system utilizing an adjustable mandrel.

BACKGROUND OF THE INVENTION

In certain types of offshore drilling, a string of casing or riser will be connected between a subsea wellhead assembly at the sea floor and a surface wellhead at a platform located at the surface. For example, with a tension leg platform, which is a buoyant platform supported with tendons held under tension, a subsea wellhead will be installed on the sea floor at the upper end of a string of conductor. A string of casing will extend into the well and have a tieback mechanism on its upper end.

An outer or low pressure riser will be secured to the subsea wellhead and extend upward to the platform. A surface wellhead will be installed at a lower deck level on the platform, approximately 90 feet below the drilling rig floor. A blowout preventer and drilling riser will connect to the surface wellhead and extend upward to the rig floor. Then, a tieback string of casing serving as a high pressure inner riser will be lowered from the platform through the blowout preventer and surface wellhead and latched into the tieback mechanism at the subsea wellhead. The operator applies tension to the tieback string and adjusts a load shoulder at the surface wellhead for maintaining the tieback string in tension. The operator then completes drilling of the well through the high pressure riser string.

A number of different systems have been used and proposed in the past for maintaining the tieback string in tension. Some of these systems employ a locking member which will ratchet on a mandrel in one direction and support weight in the other direction to maintain the string in tension. While these systems are workable, improvements to reduce cost and facilitate installation are desirable.

DISCLOSURE OF INVENTION

The system of this invention includes a mandrel which is attached into the string of casing. A hanger is attached to the mandrel by a gripping member which allows upward movement of the mandrel relative to the hanger but prevents downward movement of the mandrel relative to the hanger. The assembly is lowered through the outer riser and blowout preventer on a running string while the hanger is in an extended position relative to the mandrel. The lower end of the casing string is latched to the tieback in the subsea wellhead while the hanger external shoulder is still spaced above a load shoulder of the surface wellhead.

A launch adapter is releasibly secured to an upper end of the hanger. The launch adapter slidingly and sealingly engages the bore of the surface wellhead assembly and slidingly and sealingly engages the running string. The operator makes up the tieback with the casing while the hanger is located above the load shoulder. The blowout preventer may then be closed around the running string and hydraulic pressure applied to the launch adapter to force it downward. This causes the hanger to move downward relative to the mandrel until the shoulder of the hanger lands on the internal load shoulder. A latch on the hanger latches the hanger in place.

The running tool and mandrel may then be pulled up relative to the hanger to apply tension to the tieback casing. Then the running tool is released from the mandrel and pulled upward into engagement with the launch adapter. The running tool releases the launch adapter from the hanger and returns it to the surface.

After the drilling is completed, the tieback casing is removed and the well is completed for production. In a second embodiment, the removal of the casing is facilitated by a retractable internal load shoulder. The load shoulder comprises a plurality of dogs which can be retracted from the bore. This allows tension to be relieved in the tieback casing.

BEST MODE FOR CARRYING OUT THE INVENTION

Figure 1A:
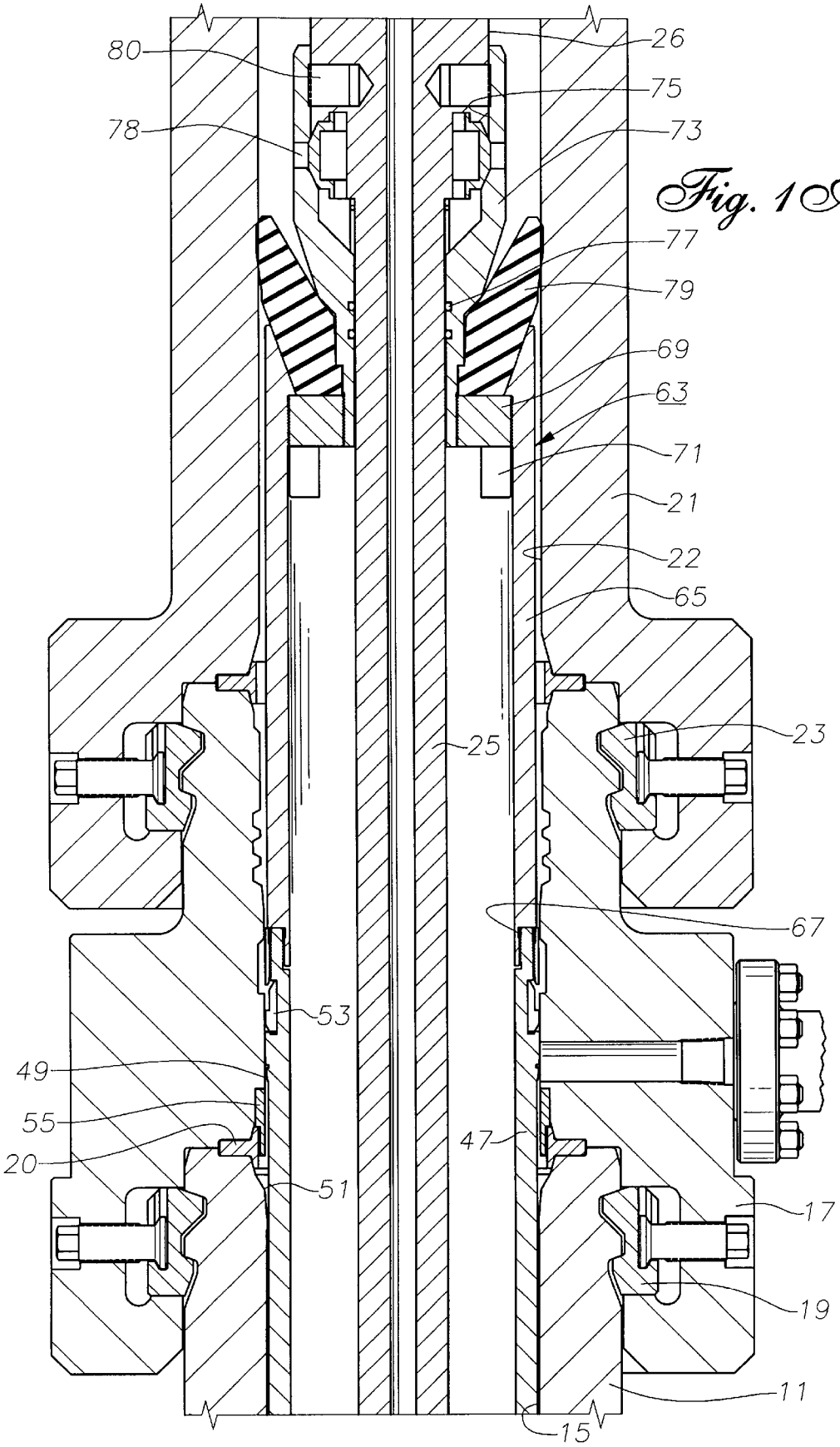
FIGS. 1A and 1B are sectional views showing a well system constructed in accordance with this invention during running in of the inner riser and prior to tieback.
Figure 1B:
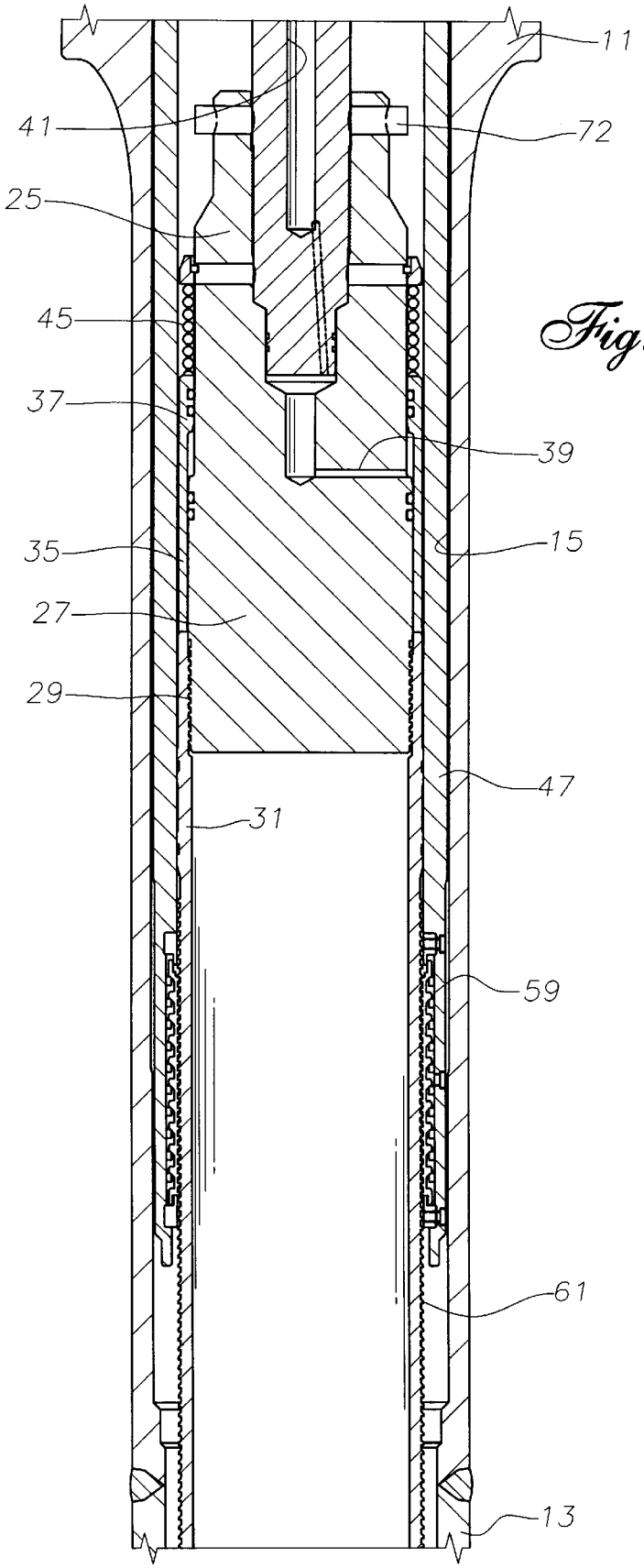

Referring to FIG. 1A, the well system includes a hanger housing 11 which is a head member that is secured to and forms a part of an outer or low pressure riser 13 (FIG. 1B). Outer riser 13 extends to a subsea wellhead (not shown). Hanger housing 11 has a bore 15 and supports a tubular wellhead spool 17. Lock members 19 secure spool 17 to grooves formed on the exterior of hanger housing 11. A metal seal 20 seals the junction between spool 17 and hanger housing 11.

In the embodiment shown, a drilling adapter, referred to herein as a launch spool 21, is mounted to the upper end of spool 17. Launch spool 21 has a bore 22 that is coaxial with bore 15. Lock members 23 engage grooves on the exterior of spool 17 to lock spool 21 in place. A drilling riser extends upward from launch spool 21 to a rig floor on a drilling vessel. Hanger housing 11 and wellhead spool 17 are part of a surface wellhead assembly that will be located on the vessel, about 90 feet below the drilling rig floor.

A landing sub 25 is a lower part of a running string that extends coaxially through hanger housing 11, spool 17 and launch spool 21. Landing sub 25 is a tubular member that has an upper end 26 which will be secured to a conduit such as drill pipe that extends upward to the rig floor. Referring to FIG. 1B, a running tool 27 is secured to the lower end of landing sub 25. Running tool 27 has left-hand threads 29 on its lower end that secure it to a tubular mandrel 31 extending downward from it. The rim of mandrel 31 has one or more slots 33 (FIG. 4) formed in it. Slot 33 is a locking slot which is engaged by a tab (not shown) of a locking member 35 of running tool 27.

Figure 4:
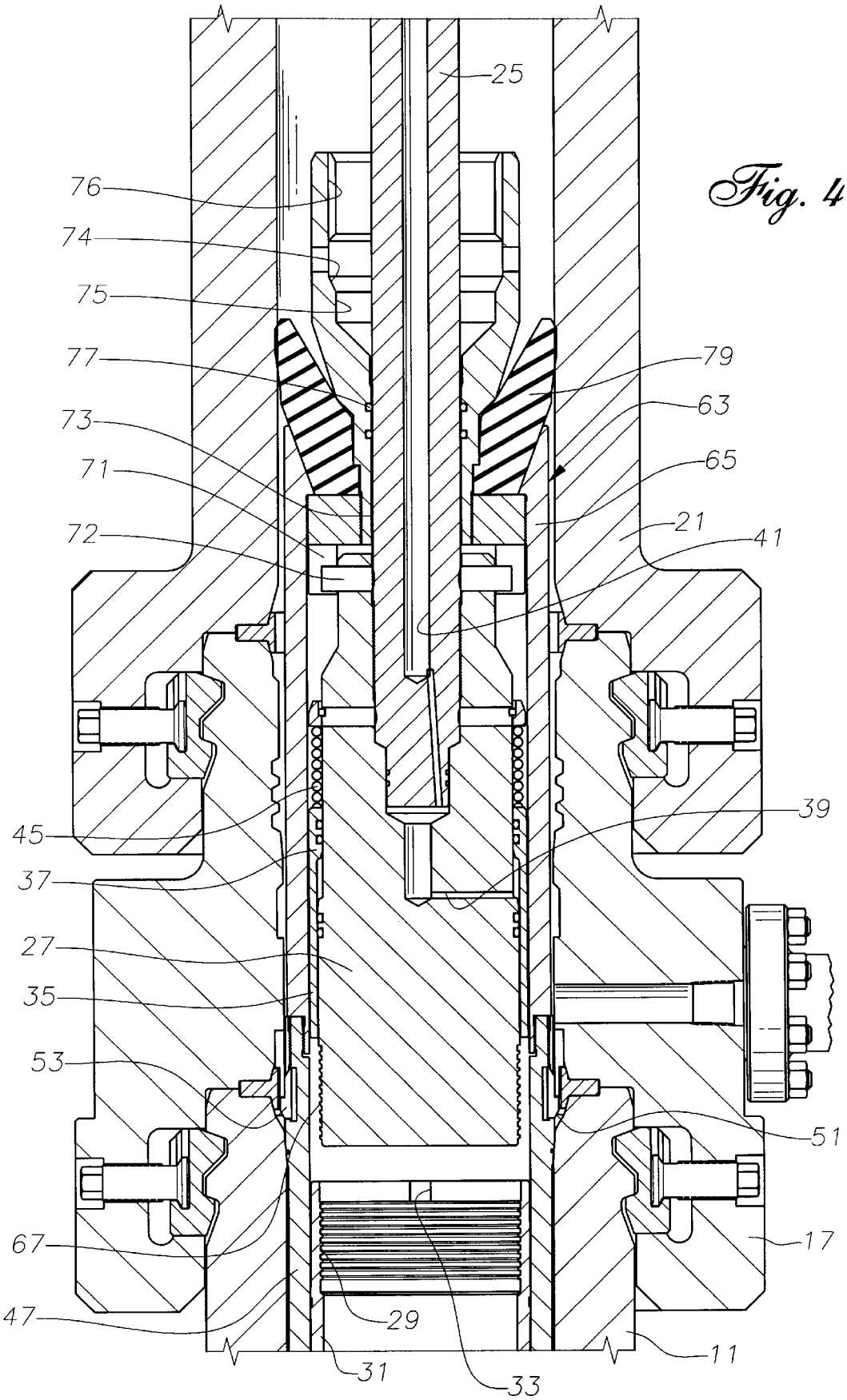
FIG. 4 is a sectional view of a portion of the well system of FIGS. 1A and 1B, but showing the running tool released from the mandrel and pulled into engagement with the launch adapter.

Locking member 35 is a sleeve which is axially moveable between a lower locked position shown in FIG. 1B, and an upper released position shown in FIG. 4. In the locked position, the tab of sleeve 35 engages slot 33 to prevent running tool 27 from unscrewing from mandrel 31. When sleeve 35 is moved upward, its tab withdraws from slot 33 (FIG. 4) to enable running 27 to be unscrewed from mandrel 31. The upward movement is handled by an annular piston 37 formed on the upper end of lock member 35. A chamber locates below piston 37. Hydraulic passages 39 allow fluid to be delivered from bore 41 in landing sub 25. A coiled spring 45 urges lock member 35 downward.

Referring again to FIG. 1A, a hanger 47 will land in the surface wellhead assembly. Hanger 47 is secured to tieback casing, also referred to as an inner riser, which extends downward to the subsea wellhead. Hanger 47 has an external shoulder 49 that is tapered for mating with an internal load shoulder 51 formed on the upper edge of hanger housing 11. The shoulders 49, 51 are configured to form a metal seal with each other.

Figure 6:
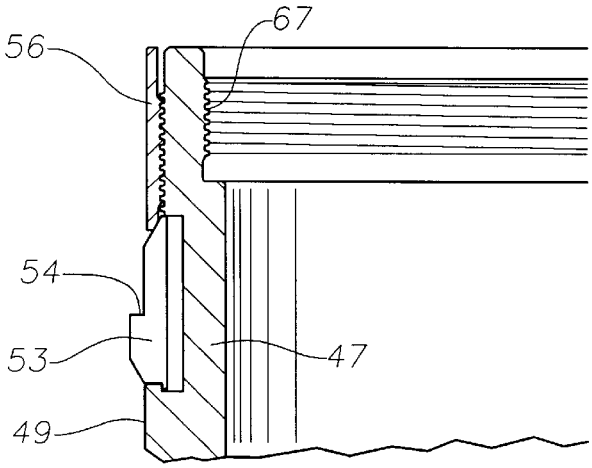
FIG. 6 is a partial enlarged sectional view of a portion of the hanger of the well system of FIG. 1.

A latch ring 53 carried by hanger 47 above shoulder 49 will latch hanger 47 to spool 17. Latch ring 53 is a split ring which has an upward facing shoulder 54, shown in FIG. 6. Latch ring 53 springs outward and shoulder 54 engages the lower edge of an insert member 55, which fits into a recess in spool 17 and overlies a portion of the inner diameter of seal 20. Once latched, latch ring 53 will prevent hanger 47 from moving upward.

Referring again to FIG. 6, latch ring 53 may be retracted for retrieving hanger 47 if needed, such as during an emergency. A threaded release ring 56 located above latch ring 53 may be rotated downward to cause latch ring 53 to retract from engagement with insert member 55 (FIG. 1A). Release ring 56 has an upper end which is flush with the upper end of hanger 47. The upper end of release ring 56 is slotted to allow a tool to engage and rotate release ring 56.

Hanger 47 has a lower portion that extends over mandrel 31. The lower portion carries a ratchet ring 59. Ratchet ring 59 will engage grooves 61 formed on the exterior of mandrel 31. Ratchet ring 59 allows upward movement of mandrel 31 relative to hanger 47, but prevents downward movement.

Referring against FIG. 1A, a launch adapter 63 is carried above hanger 47. Launch adapter 63 has a tubular outer body 65 which has left-hand threads on its lower end that secure to mating threads 67 on the upper end of hanger 47. A plate 69 is secured to the upper end of outer body 65 perpendicular to landing sub 25. A plurality of engagement lugs 71 are located on the lower side of plate 69 within outer body 65. Engagement lugs 71 are tabs that are positioned to be engaged by a bar 72 (FIG. 1B) on the upper end of running tool 27. Once engaged, rotating landing sub 25 will cause rotation of outer body 65 due to the engagement of bars 72 with lugs 71.

Launch adapter 63 also has an inner body 73. Inner body 73 is mounted to plate 69 and extends upward. Inner body 73 has a receptacle 75 that faces upward for receiving upper end 26 of landing sub 25 during running in. Receptacle 75 has an internal annular recess 74 and a set of splines 76 located above recess 74. Upper end 26 of landing sub 25 has a latch member 78, which is an annular spring that will releasably engage recess 74. Upper end 26 also has a set of torque pins 80 which engage splines 76 to transmit rotation of landing sub 25 to receptacle 75 and to hanger 47. In the running in position, upper end 26 of landing sub 25 will nest within receptacle 75, with latch member 78 holding hanger 47 in receptacle 75. With sufficient downward force on launch adapter 63, latch member 78 releases inner body 73 to allow downward movement of launch adapter 63 and hanger 47 relative to landing sub 25.

Inner body 73 has a pair of inner seals 77 that sealingly and slidingly engage landing sub 25. A cup-shaped outer seal 79 of elastomeric material is mounted to inner body 73 and extends outward into sliding and sealing engagement with bore 22 of launch spool 21.

Figure 2A:
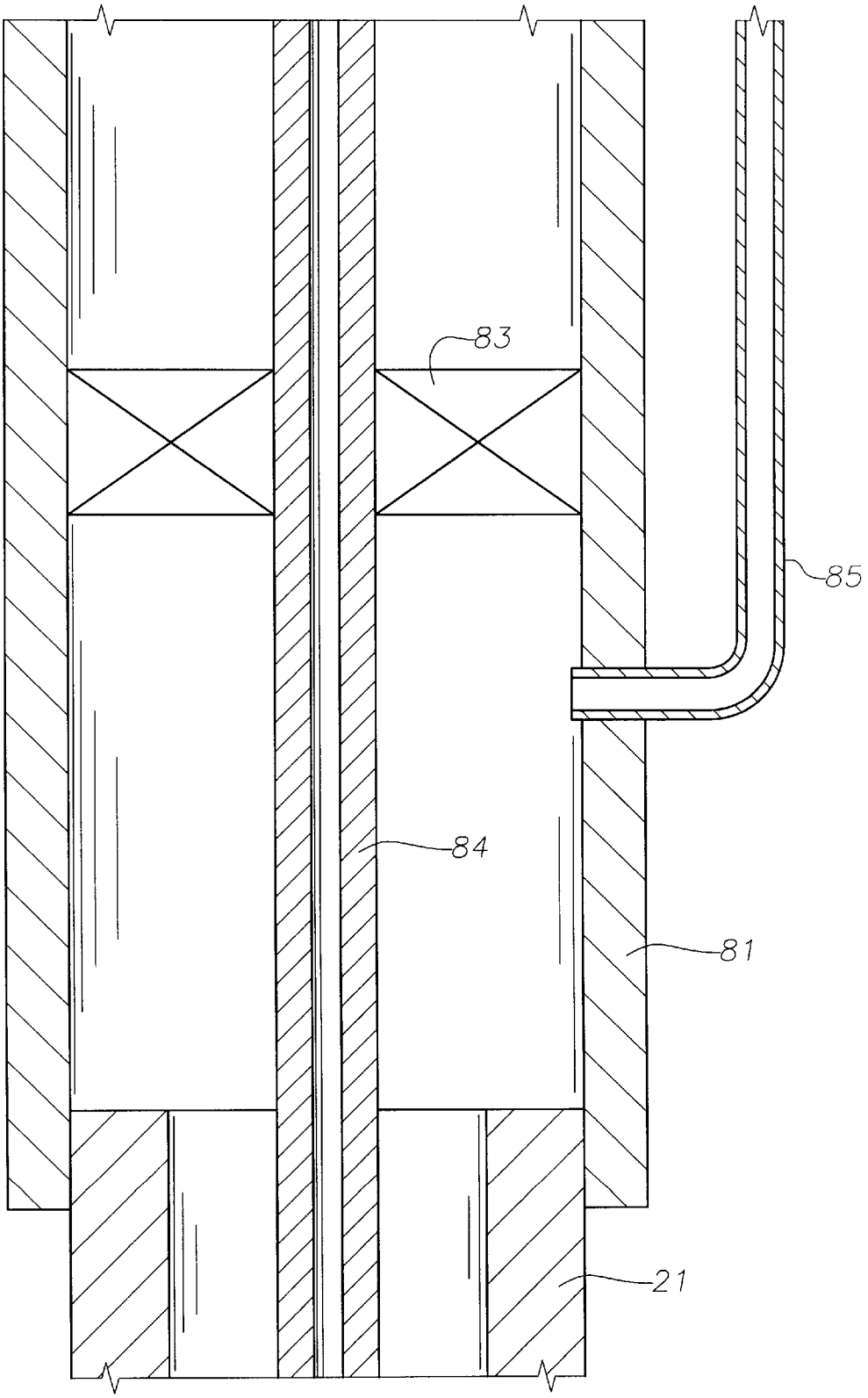
FIGS. 2A–2C are sectional views of the well system of FIGS. 1A and 1B, showing the system after the tieback has been made and the hanger pumped down onto the load shoulder.

Referring to FIG. 2A, a blowout preventer 81 is shown schematically mounted to the upper end of launch spool 21. Blowout preventer 81 has an annular seal 83 which may be closed around drill pipe 84, which secures to the upper end 26 of landing sub 25 (FIG. 1A). A choke-and-kill line 85 extends from the platform into an annulus space in blowout preventer 81 below annular seal 83.

In operation, the operator will drill a well partially, install a subsea wellhead at the sea floor, and an outer riser 13 leading to the platform. Hanger housing 11 is secured to the upper end of outer riser 13 at the lower deck level of the platform. The operator will connect wellhead spool 17 to hanger housing 11 and launch spool 21 to spool 17. A drilling riser with blowout preventer 81 (FIG. 2A) will extend to the rig floor approximately 90 feet above wellhead spool 17.

The operator will then run an inner riser or string of casing down through the drilling riser, blowout preventer 81, spools 21 and 17 and outer riser 13. The operator will attach mandrel 31 to the upper end of the casing. Hanger 47 will be secured to the outer diameter of mandrel 31 by means of ratchet ring 59. The operator secures running tool 27 to mandrel 31. Ratchet ring 59 will initially be near the upper end of grooves 61. Launch adapter 63 is secured to hanger 47 by threads 67 (FIG. 1A). Latch 78 will engage receptacle 75, holding mandrel 47 in the upper position relative to landing sub 25, as shown in FIG. 1A.

The operator continues to lower the entire assembly with drill pipe 84 (FIG. 2A) secured to the upper end of landing sub 25. The length of the tieback casing is selected so that its lower end will reach the subsea well before hanger shoulder 49 reaches internal load shoulder 51, generally shown in FIG. 1A. The distance between hanger shoulder 49 and load shoulder 51 during tieback make-up will likely be greater than that shown in FIG. 1A. The operator will make up the tieback by rotating drill pipe 84 to secure the lower end of casing 13 to the subsea wellhead assembly. The entire assembly rotates in unison. Rotating drill pipe 84 rotates launch adapter 63 through pins 80 and splines 76 and thus hanger 47. The rotation of drill pipe 84 also rotates landing sub 25, running tool 27 and thus mandrel 31 and the casing.

Figure 2B:
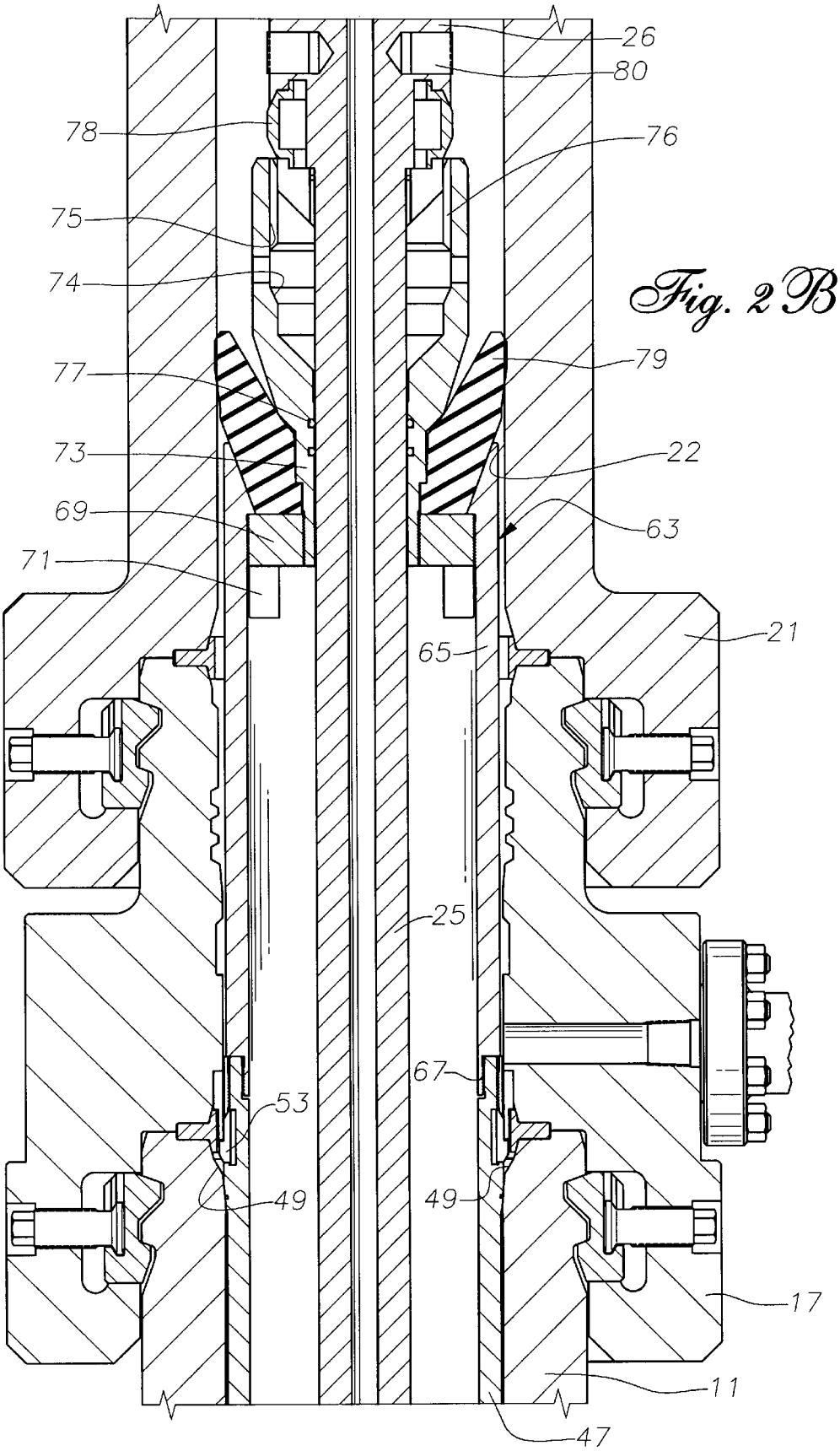
Figure 2C:
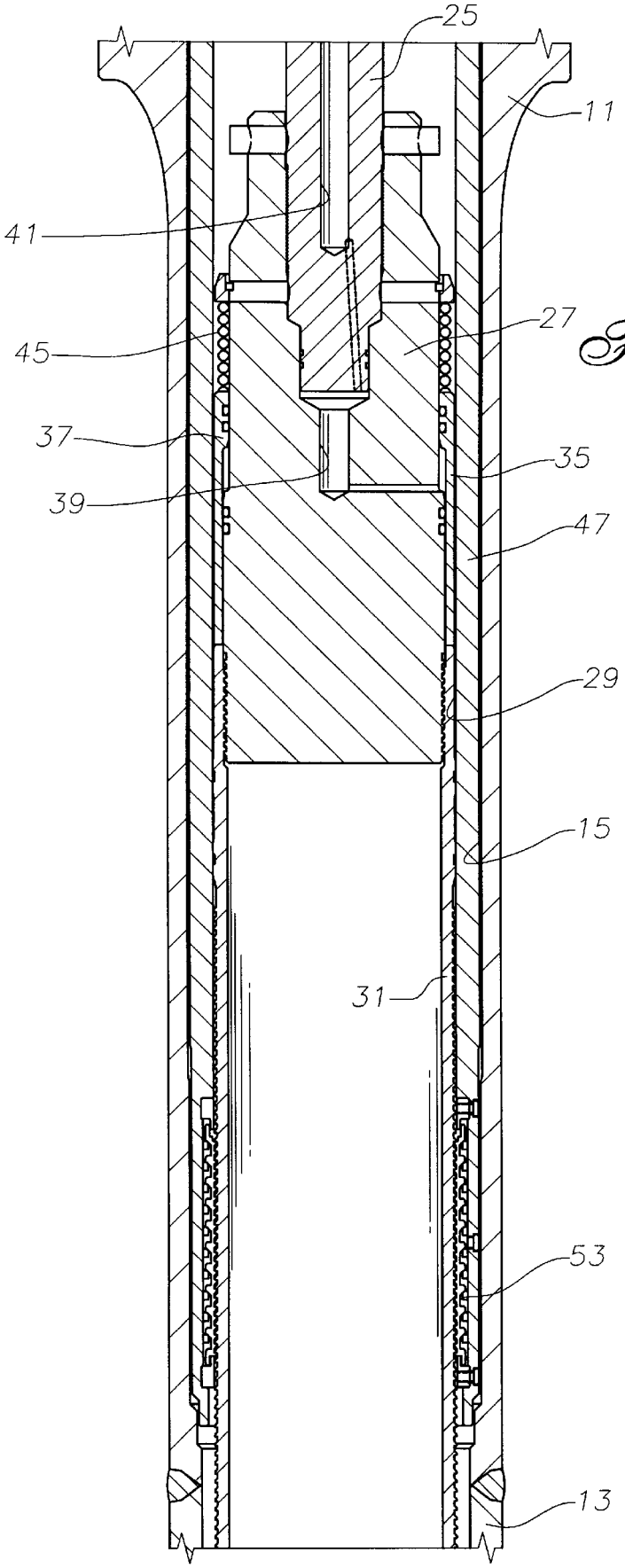

Once the tieback is made up, the operator will then close annular seal 83 of blowout preventer 81 around drill pipe 84 as shown in FIG. 2A. While holding drill pipe 84 stationary, the operator then pumps hydraulic fluid down line 85, which applies pressure to the piston created by seals 77, 79 (FIG. 1A). This pressure causes latch 78 to release and hanger 47 to move downward relative to landing sub 25 until shoulder 49 lands on shoulder 51. Latch 53 will spring out and engage insert member 55, locking hanger 47 against upward movement. Shoulders 49, 51 form a metal-to-metal seal. This is the position shown in FIG. 2B.

The operator then pulls upward on drill pipe 84 to apply tension to the tieback casing. Running tool 27 (FIG. 3A) pulls mandrel 31 move upward relative to hanger 47.

Figure 3A:
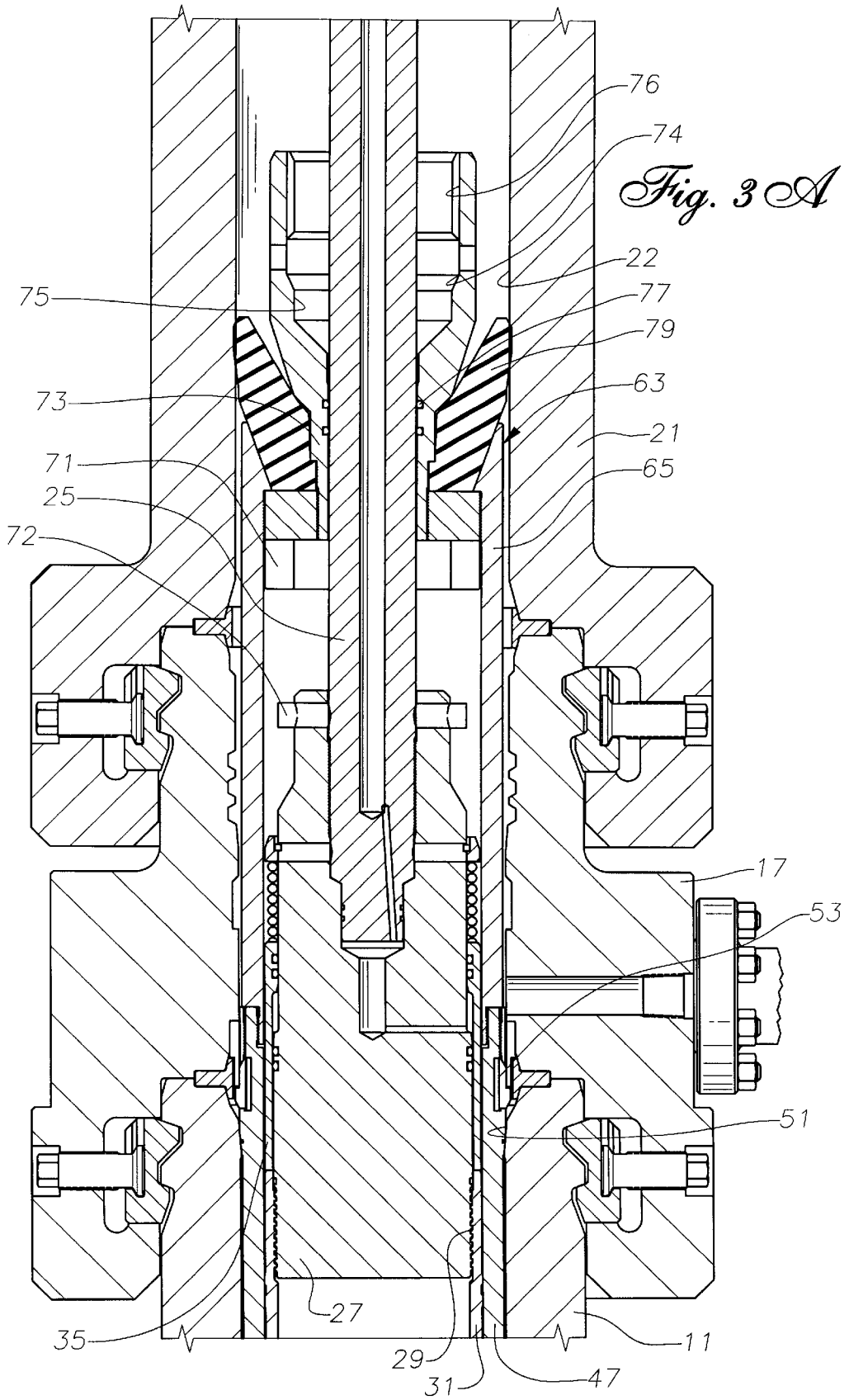
FIGS. 3A and 3B are sectional views of the well system of FIGS. 1A and 1B, but showing the running tool pulling tension on the casing string.
Figure 3B:
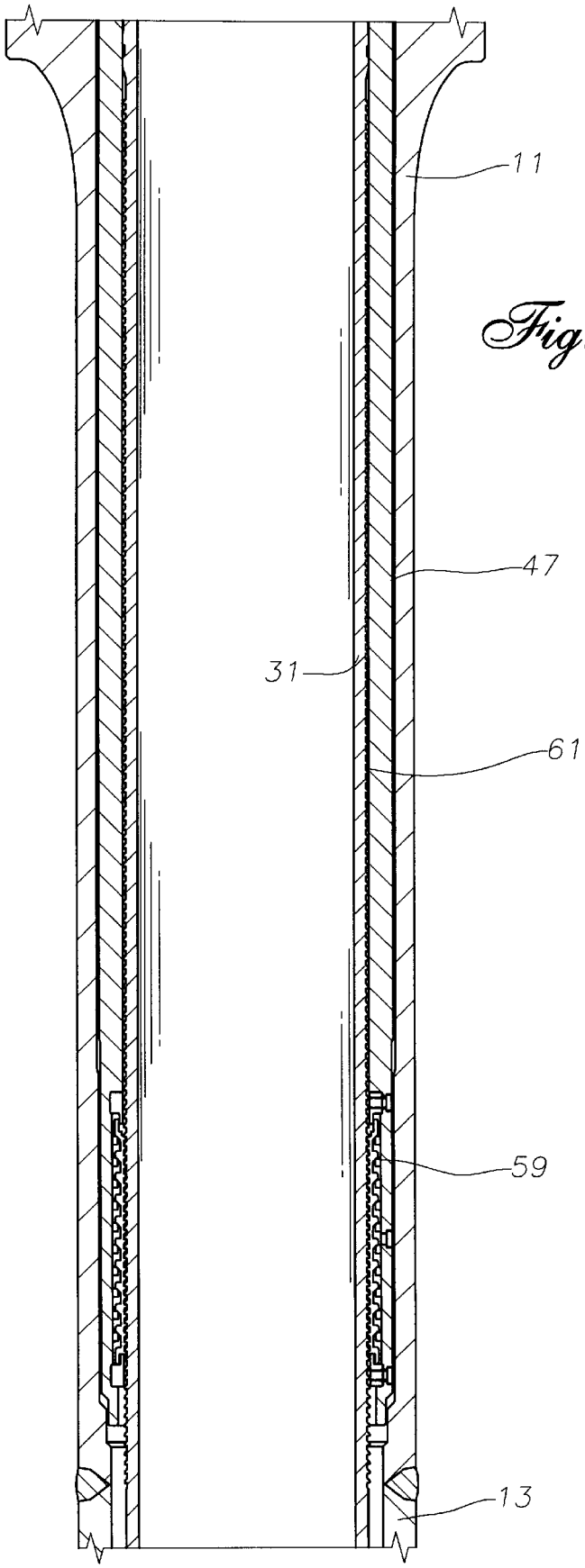

Ratchet ring 59 will ratchet on grooves 61. The operator will pull until the desired tension is reached as shown in FIGS. 3A and 3B. The operator then relaxes the upward force and ratchet ring 59 will hold tension in the casing.

Figure 5:
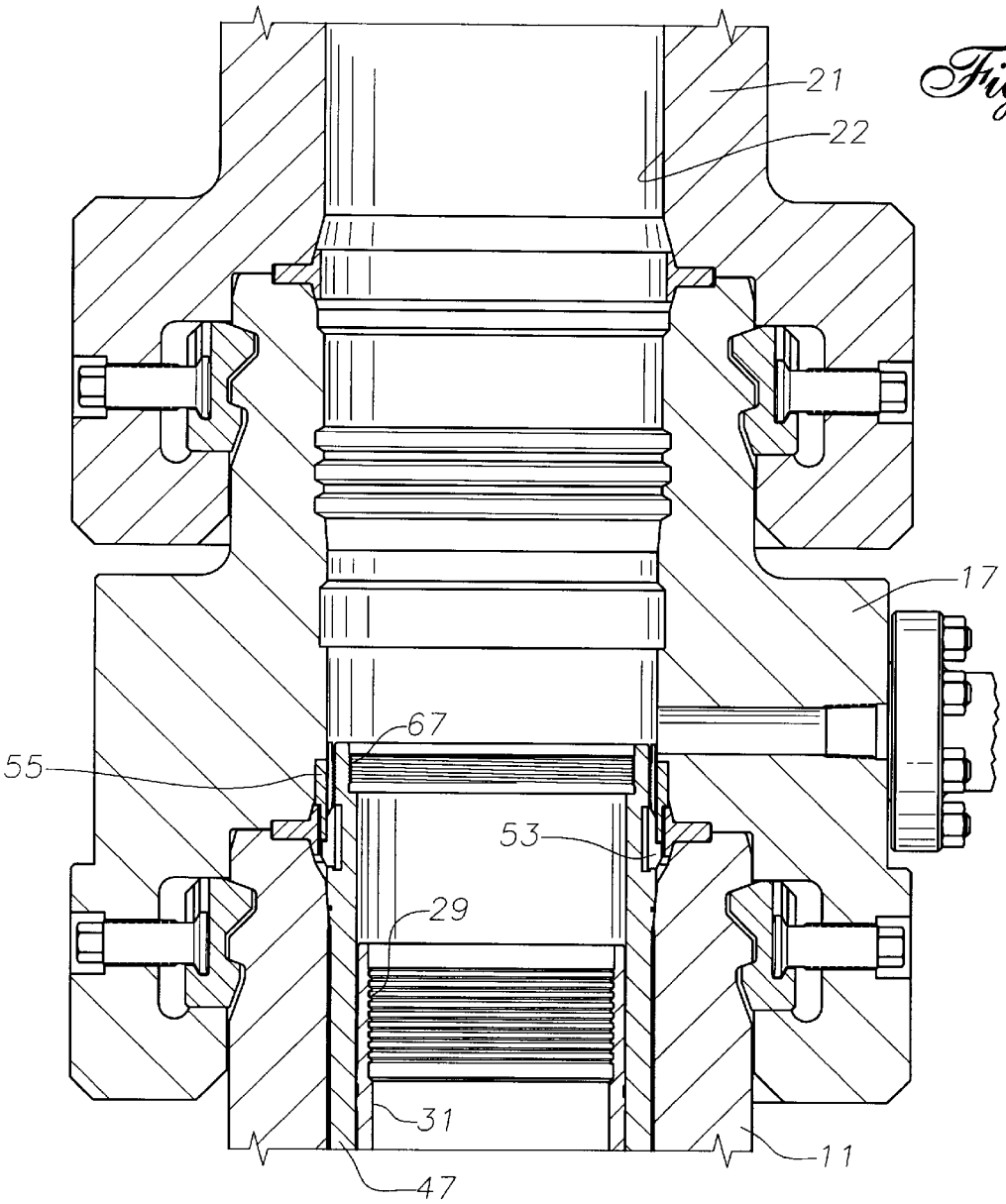
FIG. 5 is a sectional view of the well system of FIGS. 1A and 1B with the running components removed.

The operator then applies hydraulic fluid pressure through the drill pipe 84, which flows down landing sub passage 41 to cause running tool lock member 35 to move upward relative to mandrel 31. This releases the tab of lock member 35 from slot 33 (FIG. 4B). While maintaining hydraulic pressure on lock member 35, the operator then rotates drill pipe 84 (FIG. 2A) to unscrew running tool 27 from mandrel 31. Once unscrewed, the operator then lifts drill pipe 84, bringing along with it running tool 27 as shown in FIG. 4. Bars 72 of running tool 27 will engage lugs 71 when running tool 27 reaches the upper end of launch adapter 63. The operator rotates drill pipe 84 again, transmitting torque to engagement lugs 71 to unscrew outer body 65 from hanger 47. The operator then retrieves drill pipe 84, bringing along with it landing sub 25, running tool 27 and the entire launch adapter 63. This is the position shown in FIG. 5.

The operator may then continue drilling the well through blowout preventer 81 and the casing. After completion of the well, the operator will remove blowout preventer 81 and launch spool 17. Hanger 47 has a honed bore suitable for a permanent high pressure completion seal application.

Figure 7:
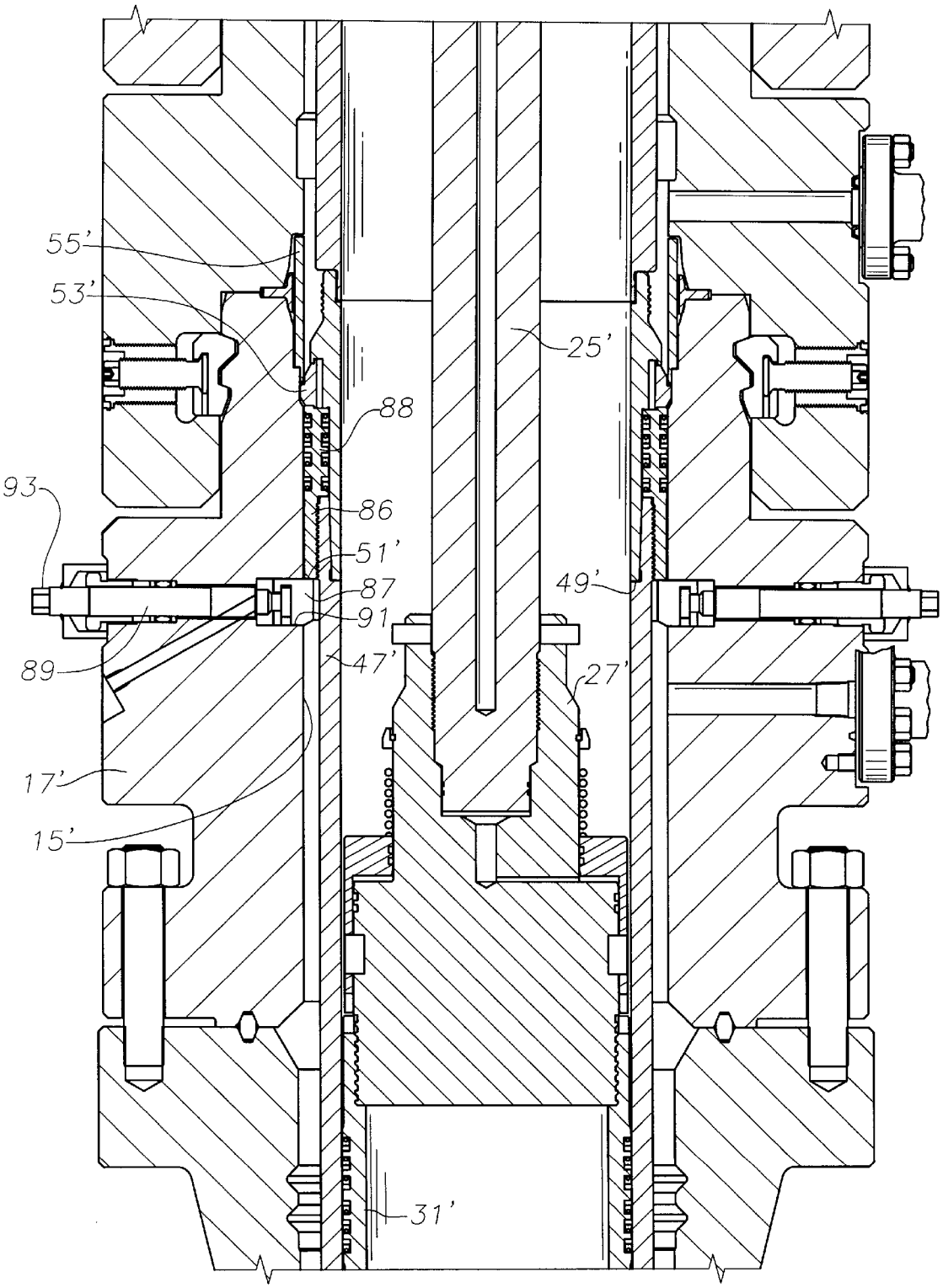
FIG. 7 is a partial sectional view of an alternate embodiment, having a retractable load shoulder.

FIG. 7 shows an alternate embodiment in which similar components to the first embodiment are labelled with the same numeral but with a prime symbol. In this embodiment, internal load shoulder 51' is retractable to facilitate removal of the tieback casing, mandrel 31', and casing hanger 47' after the drilling is completed. External load shoulder 49' on casing hanger 47' is a lower end of a sleeve 86 mounted stationarily to casing hanger 47'. Sleeve 86 has seals 88 on its inner and outer diameters for sealing casing hanger 47' to spool 17'.

Load shoulder 49' is a bottom side of sleeve 86 and it engages an upper side 51' of a plurality of dogs 87. Dogs 87 are movable radially between a retracted position in which internal load shoulder 51' protrudes into bore 15' to a retracted position retracted from bore 15'. A threaded rod 89 is attached to each of the dogs 87. Each threaded rod 89 is located within a threaded passage 91 formed in the sidewall of spool 17'. The outer end 93 of each threaded rod 89 is polygonal for engagement by a wrench. Rotating rods 89 moves dogs 87 between the retracted and extended positions.

In the operation of the second embodiment, dogs 87 will initially be in the extended position. The tieback casing is run and tensioned as described in connection with the first embodiment. Tension will be held by dogs 87. To retrieve the tieback casing, the operator reruns running tool 27' and re-engages mandrel 31'. The operator lifts running tool 27' to remove the load on dogs 87. Then threaded rods 89 are rotated to retract dogs 87. The operator then slacks off the pull on the running string, which releases tension in the tieback casing. The operator then rotates the running string to release the lower end of the tieback casing from the subsea well. The operator retrieves the entire assembly.

The invention has significant advantages. Only a single wellhead spool is required in the completed assembly as the upper or launch spool is removable after completion. The floating seal used to pump the hanger down is retrievable and does not remain with the completed well. Removing the floating seal allows a larger diameter to be utilized by the hanger. All of the service tools are removable through the blowout preventer stack. Retrieval of the tieback casing is easily performed in the second embodiment by retracting the dogs to allow tension to be released.

While the invention has been shown in only one of its forms, it should be apparent to those skilled in the art that it is not so limited but is susceptible to various changes without departing from the scope of the invention. For example, in cases where the casing does not stretch much to reach the desired tension, the launch spool may be eliminated.

I claim:

1. In an offshore well system having a subsea wellhead and a surface wellhead assembly which is located on a platform, the improvement comprising in combination:

an internal load shoulder located in a bore in the surface wellhead assembly;

a tubular mandrel which has a lower end secured to a section of casing;

a hanger having an external shoulder which lands on the internal load shoulder and a lower portion extending around the mandrel;

a gripping mechanism between the lower portion of the hanger and the mandrel for allowing upward movement of the mandrel relative to the hanger but preventing downward movement of the mandrel relative to the hanger;

a running tool which releasably engages an interior portion of the mandrel;

a landing sub secured to the running tool and extending upward through the hanger and the surface wellhead assembly;

a launch adapter releasably secured to an upper end of the hanger, the launch adapter slidably and sealingly engaging the bore of the surface wellhead assembly and slidably and sealingly engaging the landing sub, creating an annular piston in the surface wellhead assembly; whereby hydraulic pressure may be applied to the annular piston created by the launch adapter during running in to force the launch adapter and hanger downward relative to the mandrel until the shoulder of the hanger lands on the internal load shoulder;

the running tool and mandrel may be pulled upward relative to the hanger after the lower end of the casing has been secured to the subsea wellhead to apply tension to the casing, the tension being held by the gripping mechanism; and the running tool may be released from the mandrel by manipulation of the landing sub and retrieved along with the launch adapter and the landing sub.

2. The well system according to claim 1, wherein the launch adapter includes an elastomeric cup-shaped member which slidably and sealingly engages the bore of the surface wellhead assembly.

3. The well system according to claim 1, wherein the launch adapter comprises:

an inner body which has a bore that slidingly and sealingly engages the landing sub; and an elastomeric cup-shaped outer member which sealingly and slidingly engages the bore of the surface wellhead assembly.

4. The well system according to claim 1, wherein the launch adapter comprises:

an inner body which has a bore that slidingly and sealingly engages the landing sub;

an elastomeric outer member which sealingly and slidingly engages the bore of the surface wellhead assembly; and a tubular outer body which has a lower end releasably secured to the hanger.

5. The well system according to claim 1, wherein the launch adapter comprises:

a tubular outer body which has a lower end which is secured to the hanger and which is releasable from the hanger by rotation of the outer body relative to the hanger;

a seal assembly mounted to an upper end of the outer body;

an engagement lug within the inner body; and wherein pulling the running tool upward from the mandrel with the landing sub engages the running tool with the engagement lug, so that subsequent rotation of the landing sub releases the outer body from the hanger for retrieval of the launch adapter.

6. The well system according to claim 1, wherein an outer riser extends from the subsea wellhead to the surface wellhead, and wherein the surface wellhead assembly comprises:

a tubular head on an upper end of the outer riser;

a wellhead spool connected to and extending upward from the head; and wherein the internal load shoulder is in the head.

7. The well system according to claim 1, wherein the internal load shoulder comprises:

a load support mechanism which is movable from an extended position protruding into the bore of the surface wellhead assembly and a retracted position retracted from the bore of the surface wellhead assembly.

8. The well system according to claim 1, further comprising:

a latch ring mounted to the hanger for latching into a mating groove formed in the bore adjacent the internal load shoulder to hold the hanger stationary.

9. The well system according to claim 1, wherein the running tool is secured to the mandrel by threads; and wherein the running tool further comprises:

means for preventing the running tool from unscrewing from the mandrel while rotating the running tool in a first direction secure the lower end of the casing to the subsea wellhead, and for allowing the running tool to unscrew from the mandrel while rotating the running tool in the first direction after the lower end of the casing has been secured to the subsea wellhead.

10. In an offshore well system having a subsea wellhead and a surface wellhead assembly which is located on a platform, the platform having a removable drilling riser with a blowout preventer extending upward from the surface wellhead, the improvement comprising:

an internal load shoulder located in an axial bore in the surface wellhead assembly;

a tubular mandrel which has a lower end secured to a section of casing;

a hanger having an external shoulder which lands on the internal load shoulder;

a latch mounted to the hanger for latching to a mating groove in the bore to retain the hanger on the internal load shoulder, the hanger extending downward around the mandrel;

a gripping mechanism between the hanger and the mandrel for allowing upward movement of the mandrel relative to the hanger but preventing downward movement of the mandrel relative to the hanger;

a running tool which releasably engages an interior portion of the mandrel;

running string having a lower end secured to the running tool for lowering the casing into engagement with the subsea wellhead;

a launch adapter having a tubular outer body releasably secured to an upper end of the hanger by rotational movement, the launch adapter slidably and sealingly engaging the bore of the surface wellhead assembly and slidably and sealingly engaging the running string, the launch adapter having an internal engagement lug; whereby the blowout preventer may be closed around the running string and hydraulic pressure applied to the launch adapter to force the launch adapter and hanger downward relative to the mandrel until the shoulder of the hanger lands on the internal load shoulder;

the running tool and mandrel may be pulled upward relative to the hanger after the lower end of the casing has been secured to the subsea wellhead to apply tension to the casing, the tension being held by the gripping mechanism; and the running tool may be released from the mandrel and brought upward into contact with the engagement lug by lifting the running string, wherein rotating the running string releases the launch adapter from the hanger for retrieval along with the running tool.

11. The well system according to claim 10, wherein the launch adapter includes an elastomeric cup-shaped member which sealing engages the bore of the surface wellhead assembly.

12. The well system according to claim 10, wherein the launch adapter comprises:

an inner body which has a bore that slidingly and sealingly engages the running string; and an elastomeric cup-shaped outer member which sealingly and slidingly engages the bore of the surface wellhead assembly.

13. The well system according to claim 10, further comprising an outer riser extending from the subsea wellhead to the surface wellhead, and wherein the surface wellhead assembly comprises:

a tubular head on an upper end of the outer riser;

a spool connected to and extending upward from the head; and wherein the internal load shoulder is in the head.

14. The well system according to claim 10, wherein the gripping mechanism comprises:

a plurality of circumferentially extending parallel grooves on an exterior portion of the mandrel; and a ratchet ring carried by the extension portion which ratchets on the grooves as the extension portion moves downward relative to the mandrel and while the mandrel is pulled upward relative to the hanger, but engages the grooves to support a load when the mandrel attempts to move downward relative to the extension pipe.

15. The well system according to claim 10, wherein the running string comprises:

a landing sub secured to a string of conduit, the running tool being secured to a lower end of the landing sub, the landing sub having an upper end; and a latch on the upper end of the landing sub which releasably engages the launch adapter to hold the launch adapter and running tool stationary relative to each other during running in.

16. The well system according to claim 10, wherein the running tool is secured to the mandrel by threads; and wherein the running tool further comprises:

an axially moveable locking member mounted to the running tool which has a locking position for preventing rotation of the running tool relative to the mandrel while rotating the running tool in a first direction to secure the lower end of the casing to the subsea wellhead, and which has a released position which allows the running tool to unscrew from the mandrel while rotating the running tool in the first direction after the lower end of the casing has been secured to the subsea wellhead; and the locking member being axially moveable relative to the running tool between the locked and unlocked positions in response to hydraulic fluid pressure supplied through the running string.

17. The well system according to claim 10, wherein the internal load shoulder comprises:

a plurality of dogs which are movable from an extended position in which the dogs protrude into the bore of the surface wellhead assembly and a retracted position wherein the dogs are retracted from the bore of the surface wellhead assembly.

18. In an offshore well system having a subsea wellhead and a surface wellhead assembly which is located on a platform and which has an axial bore, the improvement comprising in combination:

a load support mechanism which is radially movable from an extended position protruding into the bore of the surface wellhead assembly and a retracted position retracted from the bore of the surface wellhead assembly;

a tubular mandrel which has a lower end secured to a section of casing;

a hanger having an external shoulder which lands on the load support mechanism while in the extended position, the hanger having a lower portion extending around the mandrel;

a gripping mechanism between the lower portion of the hanger and the mandrel for allowing upward movement of the mandrel relative to the hanger but preventing downward movement of the mandrel relative to the hanger;

a running tool which is lowered on a conduit from the platform, the running tool releasably engaging an interior portion of the mandrel for securing the lower end of the casing to the subsea wellhead;

wherein the running tool and mandrel may be pulled upward relative to the hanger after the lower end of the casing has been secured to the subsea wellhead to apply tension to the casing, the tension being held by the gripping mechanism to allow removal of the running tool; and wherein to retrieve the casing, the running tool may be again lowered into engagement with the mandrel and the load support mechanism moved to the retracted position to relieve the tension in the casing.

19. The well system according to claim 18 wherein the load support mechanism comprises a plurality of dogs spaced circumferentially around the bore.

20. The well system according to claim 19, further comprising:

a plurality of threaded rods extending radially through the surface wellhead assembly, each in engagement with one of the dogs, for moving the dogs between the retracted and extended positions by rotating the rods.

21. A method for connecting a casing string between a subsea wellhead and a surface wellhead assembly located on a platform, comprising:

providing an internal load shoulder within an axial bore in the surface wellhead assembly;

attaching a lower end of a mandrel to the casing string;

mounting a running tool to a running string and releasably engaging the running tool with the mandrel;

providing a hanger which has an external shoulder and providing the hanger with an internal gripping member which engages the mandrel to allow upward movement of the mandrel relative to the hanger but prevent downward movement of the mandrel relative to the hanger;

releasably securing a launch adapter to an upper end of the hanger, the launch adapter slidably and sealingly engaging the bore of the surface wellhead assembly and slidably and sealingly engaging the running string;

connecting a riser and a blowout preventer to the surface wellhead and lowering the casing string through the riser, blowout preventer and surface wellhead;

securing a lower end of the casing string to the subsea wellhead while the external shoulder of the hanger is spaced above the load shoulder; then closing the blowout preventer around the running string and applying hydraulic pressure to the launch adapter, which forces the hanger and the lower extension downward relative to the mandrel until the external shoulder lands on the load shoulder; then pulling upward on the running string and the mandrel while maintaining the external shoulder of the hanger on the load shoulder to apply tension to the casing string, and once a desired amount of tension is reached, relaxing the pull, causing the gripping member to grip the mandrel to support the casing string in tension; then releasing the running tool from the mandrel and pulling it upward with the running string into engagement with the launch adapter; then releasing the launch adapter from the hanger and retrieving the running string, launch adapter and running tool.

22. The method according to claim 21, wherein the step of releasing the launch adapter from the hanger comprises rotating the running string to cause relative rotation between the launch adapter and the hanger.

23. The method according to claim 21, wherein the step of pulling upward on the running string and the mandrel while maintaining the external shoulder of the hanger on the load shoulder comprises first latching the hanger to the wellhead assembly on the load shoulder.

24. The method according to claim 21, wherein the step of providing the internal shoulder comprises providing a load supporting mechanism which is movable from an extended position protruding into the bore and a retracted position out of the bore; and wherein the method further comprises retrieving the casing string by the following steps:

lowering the running tool back into engagement with the mandrel; then moving the load supporting mechanism to the retracted position and slacking off weight on the running tool to remove tension in the casing string; then retrieving the running tool and the casing string.

25. A method for connecting and removing a casing string between a subsea wellhead and a surface wellhead assembly which has a bore and which is located on a platform, comprising:

(a) providing a load support mechanism within the surface wellhead assembly which is movable from an extended position protruding into the bore and a retracted position retracted from the bore;

(b) attaching a lower end of a mandrel to the casing string;

(c) mounting a running tool to a running string and releasably engaging the running tool with the mandrel;

(d) providing a hanger which has an external shoulder and providing the hanger with an internal gripping member which engages the mandrel to allow upward movement of the mandrel relative to the hanger but prevent downward movement of the mandrel relative to the hanger;

(e) securing a lower end of the casing string to the subsea wellhead;

(f) landing the external shoulder of the casing hanger on the load support mechanism while the load support mechanism is in the extended position;

(g) pulling upward on the running string and the mandrel to apply tension to the casing string, and supporting the tension through the external shoulder of the casing and the load support mechanism; then (h) releasing the running tool from the mandrel and retrieving the running string; then, to retrieve the casing, (i) running the running tool back into engagement with the mandrel with the running string and pulling upward on the running string; then (j) retracting the load supporting mechanism and lowering the running string to remove the tension in the casing; then (k) releasing the casing from the subsea wellhead and retrieving the casing with the running string.

* * * * *